US009537195B2

(12) United States Patent
Sun et al.

(10) Patent No.: US 9,537,195 B2
(45) Date of Patent: Jan. 3, 2017

(54) RECTANGULAR BAND-PASS FILTER HAVING RECESSES OF LESS THAN ONE-QUARTER WAVELENGTH DEPTH FORMED THEREIN FOR FITTING A DIELECTRIC INSERT WITH A SUPERCONDUCTIVE FILM WITHIN THE RECESSES

(71) Applicants: Institute of Physics, Chinese Academy of Sciences, Beijing (CN); Beijing Huarong Tianchuang Superconduct Technology Development Co., Ltd., Beijing (CN); University of Science and Technology Beijing, Beijing (CN); O.Ya. Usikov Institute for Radiophysics and Electronics, National Academy of Sciences of Ukraine, Kharkiv (UA)

(72) Inventors: Liang Sun, Beijing (CN); Xu Wang, Beijing (CN); Jia Wang, Beijing (CN); Yun Wu, Beijing (CN); Yusheng He, Beijing (CN); Hong Li, Beijing (CN); Jiangming Huang, Beijing (CN); Sheng Luo, Beijing (CN); Valerii Skresanov, Kharkiv (UA); Oleksandr Barannyk, Kharkiv (UA); Volodymyr Glamazdin, Kharkiv (UA); Volodymyr Zolotarev, Kharkiv (UA); Myhaylo Natarov, Kharkiv (UA); Mykola Cherpak, Kharkiv (UA); Oleksandr Shubnyj, Kharkiv (UA)

(73) Assignees: Institute of Physics, Chinese Academy of Sciences, Beijing (CN); Beijing HuarontTianchuang Superconduct Tech Dev Co, Beijing (CN); University of Science and Technology Beijing, Beijing (CN); Usikov Inst Radiophysics & Electronics, NASU, Kharkiv (UA)

( * ) Notice: Subject to any disclaimer, the term of this patent is extended or adjusted under 35 U.S.C. 154(b) by 0 days.

(21) Appl. No.: 14/581,483

(22) Filed: Dec. 23, 2014

(65) Prior Publication Data

US 2015/0188208 A1 Jul. 2, 2015

(30) Foreign Application Priority Data

Dec. 26, 2013 (UA) ..... a 2013 15299

(51) Int. Cl.
*H01P 1/207* (2006.01)
*H01P 5/10* (2006.01)
*H01P 1/201* (2006.01)

(52) U.S. Cl.
CPC ..... *H01P 1/207* (2013.01); *H01P 1/2016* (2013.01); *H01P 5/1007* (2013.01)

(58) Field of Classification Search
CPC ..... H01P 1/2016; H01P 1/207; H01P 1/211; H01P 5/1007; H01P 5/1015
(Continued)

(56) References Cited

U.S. PATENT DOCUMENTS 4,052,683 A * 10/1977 van Heuven et al. .. H01P 5/107 333/21 R
4,761,625 A * 8/1988 Sharma ..... H01P 1/207 333/209
4,970,522 A * 11/1990 Niman ..... H01P 3/12 333/237

OTHER PUBLICATIONS

Siegman A. E., Microwave Solid-State Masers, New York-San Francisco-Toronto-London: McGraw-Hill Book Company, pp. 402-403 (1964).

(Continued)

*Primary Examiner* — Benny Lee
(74) *Attorney, Agent, or Firm* — Mei & Mark LLP; Manni Li

(57) ABSTRACT

A band-pass filter having a body, a rectangular waveguide, and a dielectric insert, the dielectric insert has a dielectric plate and a high temperature superconductive film in line with a plurality of rectangular windows of the same height. The waveguide has a×b cross-section, a being length of the long side walls and b the length of the short side walls. Each long side wall has a fixing groove at the central portion and a rectangular recess in the fixing groove. The dielectric plate has two ends in the fixing grooves and is symmetric with a perpendicular bisecting plane of the long side wall. The rectangular recess is symmetric to the perpendicular bisecting plane and has the same length as that of the waveguide, with its width w satisfying $t<w<a/2$, and depth d satisfying $d<\lambda/4$, t being total thickness of the dielectric plate and the high temperature superconductive film, and $\lambda$ the wavelength of the central frequency of the pass-band of the band-pass filter.

9 Claims, 6 Drawing Sheets

(58) Field of Classification Search
USPC ..... 333/208, 99 S; 505/210
See application file for complete search history.

(56) References Cited

OTHER PUBLICATIONS

Vahldieck R. et al., Optimized Waveguide E-Plane Metal Insert Filters for Millimeter—Wave Applications, IEEE Trans. Microwave Theory Tech., vol. 31, No. 1, pp. 65-69 (1983).
Arndt F. et al., Theory and Design of Low-Insertion Loss Fin-Line Filters, IEEE Trans. Microwave Theory Tech. vol. 30, No. 2, pp. 155-163 (1982).
Mansour R.R. et al., Superconductive Millimeter—Wave E-Plane Filters, IEEE Trans. Microwave Theory Tech. vol. 39, No. 9, pp. 1488-1492, (1991).
Liang Han et al., Design and Performance of Waveguide E-Plane HTSC Insert Filters, 1992 IEEE MTT-S Digest, pp. 913-916 (1992).
Skresanov V.N. et al., Experience in Developing Ka-Band Waveguide Filter with HTS E-Plane Plane Insert, 8th International Kharkov Symposium on Physics and Engineering of Microwaves, Millimeter and Submillimeter Waves (MSMW'2013) Kharkov, Ukraine (Jun. 23-28, 2013).
Tham Q.C., Modes and Cutoff Frequencies of Crossed Rectangular Waveguides, IEEE Trans. Microwave Theory Tech. vol. 25, No. 7, pp. 585-588, (1977).
G.L. Matthae et al., Microwave Filters, Impedance-Matching Networks, and Coupling Structures, McGraw-Hill Co., pp. 426-435 (1968).
V.N. Skresanov et al., Novel Approach to Coupled Mode Parameters Recovery from Microwave Resonator Amplitude—Frequency Response, European Microwave Conference. (EuMW 2011 Conference Proceedings), Manchester, U.K., EuMA 2011, pp. 826-829 (Oct. 9-14, 2011).
G.L. Matthae et al., Microwave Filters, Impedance-Matching Networks, and Coupling Structures, McGraw-Hill Co., pp. 662-669 (1968).
G.L. Matthae et al., Microwave Filters, Impedance-Matching Networks, and Coupling Structures, McGraw-Hill Co., pp. 674-675 (1968).

* cited by examiner

RECTANGULAR BAND-PASS FILTER HAVING RECESSES OF LESS THAN ONE-QUARTER WAVELENGTH DEPTH FORMED THEREIN FOR FITTING A DIELECTRIC INSERT WITH A SUPERCONDUCTIVE FILM WITHIN THE RECESSES

CROSS-REFERENCE TO RELATED APPLICATION

The subject application claims the benefit of Ukrainian Patent Application No. a 2013 15299 filed on Dec. 26, 2013 in the Patent Office of Ukraine, the whole disclosure of which is incorporated herein by reference.

BACKGROUND OF THE INVENTION

Field of the Invention

The present invention relates to a microwave technique, particularly, to a band-pass filter, which can be used in cryo-electronic units at a front end of a receiver used in radio telescopes and satellite communication lines.

Description of the Related Art

Band-pass filters that are installed at input ends of low-noise amplifiers (LNAs) are designed to provide electromagnetic compatibility for radio electronic facilities, i.e., to protect input circuits of a highly sensitive receiver from being affected by electromagnetic radiation outside the operating bandwidth. Currently, transistor LNAs are widely used and replace the previously developed parametric and quantum amplifiers because of their lower noise temperature, broad bandwidth, and operational advantages (stability, efficiency, and ability to operate at cryogenic temperature).

A main characteristic of highly sensitive receivers is the equivalent noise temperature $T_R$ of the receiver, which is mainly determined by noise temperature $T_A$ of the LNAs and noise temperature $T_F$ of passive circuits at the input of the LNAs (for example, a band-pass filter), that is, $T_R=T_F+T_A$. To decrease the $T_R$, the transistor LNA is cooled to cryogenic temperatures. The noise temperature of the band-pass filter depends on its physical temperature $T_0$ and insertion loss $L_{dB}$. In the case of the low insertion loss ($L_{dB}<0.5$ dB), noise temperature of the band pass filter is defined by a simple formula: $T_F=(L_{dB}/4.34)T_0$, see Siegman, A. E., Microwave Solid-State Masers, New York-San Francisco-Toronto-London, McGraw-Hill Book Company, 1964. For an element with an insertion loss of 0.1 dB, the noise temperature is 7 K at an operation temperature of 300 K, and the noise temperature is decreased to 1.4K at an operation temperature of 60K. Therefore, the advantage of decreasing the temperature of the front end of the receiver is obvious.

The smaller the insertion loss $L_{dB}$ of the band-pass filter is, the lower the noise temperature $T_F$ is. It follows that band-pass filters, made of materials with high conductivity or low value of the microwave surface resistance $R_s$, have advantage. This is why high-temperature superconductivity (HTS) materials are used in the design of the band-pass filter. Further, the value of the surface resistance $R_s$ of the HTS materials is lower than that of the surface resistance $R_s$ of the conventional metals by several orders, and on the other hand, the HTS materials are in the superconductive state at a cryogenic temperature of or a temperature lower than the temperature of liquid nitrogen (about 77 K), and hence, reliable and economical cryo-coolers can be used in the cryo-electronic unit of the receiver. Currently, the technology of HTS materials has reached a high level such that HTS materials can be used in technical devices. The invention provides a band-pass filter, which uses HTS material in a form of HTS film deposited on the side surface of the dielectric plate (substrate) with low dielectric losses (e.g., superconductive layers of YBaCuO on MgO substrate).

Multi-pole band-pass filters with the so-called E-plane metal insert in a rectangular waveguide are well known. See Vahldieck, R., Bornemann, J., Arndt F., and Graueryolz, D., Optimized Waveguide E-Plane Metal Insert Filters for Millimeter—Wave Applications, IEEE Trans. Microwave Theory Tech., Vol. 31, No. 1, 1983, pp. 65-69. In the E-plane of the rectangular waveguide between the long side walls, a number of metal strips are installed, and regular rectangular waveguides are formed between the metal strips. The regular rectangular waveguides correspond to the resonators in the filter, and the resonators are coupled by means of two portions of the regular rectangular waveguide which are separated by the metal strips. End portions of the rectangular waveguide separated by the metal strips are elements of the filter for coupling with input and output transmission lines.

Fin-line filters, which are band-pass filters based on the principles used in band-pass filters with the E-plane metal insert, are proposed. Instead of an E-plane metal insert, an E-plane dielectric insert is used in the filter. Metal strips of the conventional metal are applied to one or both side surfaces of the insert, see, e.g., Arndt, F., Bornemann, J., Grauneryolz, D., and Vahldieck, R., Theory and Design of Low-Insertion Loss Fin-Line Filters, IEEE Trans. Microwave Theory Tech., Vol. 30, No. 2, 1982, pp. 155-163. Such designs have advantages in the millimeter wavelength range, because the photolithography technology for production which allows maintaining the exact dimensions of metal strips can be used.

The idea of using the inserts from HTS materials instead of the fin-line inserts in the E-plane of band-pass filters has been first expressed in the work of Mansour, R. R. and Zybura, A., Superconductive Millimeter-Wave E-Plane Filters, IEEE Trans. Microwave Theory Tech., Vol. 39, No. 9, 1991, pp. 1588-1492. Experimental study of such a filter has been carried out in the work of Liang Han, Yiyuan Chen, and Yunyi Wang, Design and Performance of Waveguide E-Plane HTSC Insert Filters, 1992 IEEE MTT—S Digest, pp. 913-916. The inventors for the subject application investigated the characteristics of the band-pass filter with an E-plane insert of the HTS material in comparison with the characteristics of the band-pass filter with E-plane inserts of the conventional metal, see Skresanov, V. N., Barannik, A. A., Cherpak, N. T., Y. He, Glamazdin, V. V., Zolotaryov, V. A., Shubny, A. I., Sun L., Wang J., and Wu Y., Experience in Developing Ka-Band Waveguide Filter with HTS E-Plane Insert, the 8th International Kharkov Symposium on Physics and Engineering of Microwaves, Millimeter and Submillimeter Waves (MSMW '2013), Kharkov, Ukraine, Jun. 23-28, 2013. In particular, it has been shown that the advantages of the band-pass filters with the E-plane insert of the HTS material cannot be realized if the problem of providing high-quality contact between the HTS insert and the waveguide walls is not solved. Contact area should have small losses of the microwave power, good thermal contact between the HTS insert and the waveguide walls must be ensured, and the destruction of the fragile substrate plate in cooling-heating cycles of the filter must be prevented.

The closest analogue on the technical essence of the pass-band filter studied by Skresanov et al. is the pass-band filter which comprises a rectangular waveguide of a×b cross-section and a dielectric plate, and on both surfaces of the dielectric plate, high temperature superconductive films are placed with a number of windows. Specifically, the windows are symmetric relative to a dissecting plane of the rectangular waveguide in the height direction, and have the same height, different length, and at different distances relative to each other. The dielectric plate is mounted in an axial plane perpendicular to the long side walls of the waveguide, see Liang Han, Yiyuan Chen, and Yunyi Wang, Design and Performance of Waveguide v E-Plane HTSC Insert Filters, 1992 IEEE MTT—S Digest, pp. 913-916. Lengths of rectangular windows, as well as the distances between the windows, are calculated, and the lengths and the distances are different for different windows. These dimensions determine the Eigen frequencies of the resonators, coefficients of mutual coupling between the resonators and the coupling coefficient of the resonators with the transmission lines, which in turn are determined by the characteristics of the band-pass filter to be achieved. The pass-band filter is a natural development of the known band-pass filters with E-planar fin-line inserts, and can reduce insertion loss due to lower surface resistance $R_s$ of microwave HTS materials compared to conventionally metals. Another technical solution for reducing the insertion loss, which can be combined with the technical solution for reducing the insertion loss by the known band-pass filters with E-planar fin-line inserts, is to redistribute the microwave currents in the waveguide walls by means of the currents in the conductive surfaces of the insert after the dielectric insert is inserted into waveguide.

However, the current band-pass filter has the following technical disadvantages. One of the components of the insertion loss, i.e, the scattering of the microwave power in the contact area between the HTS films and the waveguide walls, should be smaller as compared with the heat Joule loss in the HTS films. In the current band-pass filters, the requirement of the scattering of the microwave power being smaller than the heat Joule loss can be achieved if the surface of the filter housing is polished and thus mechanically in close contact with the HTS films of the insert. The dielectric plate (substrate) should be made of materials with low dielectric losses and a crystal lattice close to the crystal structure of the HTS film. Some single crystal dielectric plates, such as MgO, $LaAlO_3$, and $Al_2O_3$, have the properties of low dielectric losses and crystal lattices close to the crystal structure of the HTS film, however, the dielectric plates are fragile and may be easily damaged in the cooling-heating cycles of the filter due to close mechanical contact with the filter body. The technical problem of the dielectric plate being easily damaged still cannot be solved, even if the filter body is made of a material with a coefficient of a linear expansion close to that of the dielectric plates, (for example, the filter body is made of titanium, while the filter body is made of MgO). The reason is that temperature gradients that are caused during the cooling in the filter body introduce unacceptable mechanical stresses in the dielectric plate.

SUMMARY OF THE INVENTION

The present invention has been made to overcome or alleviate at least one aspect of the disadvantages of the current band-pass filters.

According to an exemplary embodiment of the present invention, a band-pass filter is provided. The filter comprises a body; a rectangular waveguide defined in the body and having a a×b cross-section, wherein a is a length of a long side wall of the waveguide, b is a length of a short side wall of the waveguide, and each long side wall is provided at a central portion thereof with a fixing groove; and a dielectric insert having two ends, the two ends of the dielectric insert are placed in the fixing grooves respectively, the dielectric insert is arranged to be symmetric with respect to a perpendicular bisecting plane of the long side wall, wherein the dielectric insert comprises a dielectric plate and a high temperature superconductive film having a plurality of rectangular windows of the same height, wherein each long side wall is provided with a rectangular recess in which a corresponding one of the fixing grooves is formed, each rectangular recess is symmetric about the perpendicular bisecting plane, a length of the rectangular recess is the same as that of a waveguide, the width w of each rectangular recess is less than the length a and is greater than a total thickness t of the dielectric plate and the high temperature superconductive film.

Alternatively, a depth d of each rectangular recess satisfies $d<\lambda/4$, wherein $\lambda$ is a wavelength corresponding to a central frequency of the pass-band of the band-pass filter.

Alternatively, the width w of each rectangular recess satisfies $t<w<a/2$.

Alternatively, a thermal conductive layer is provided between an inner wall of each fixing groove and an outer surface of a corresponding end of the dielectric insert placed thereinto, wherein the thermal conductive layer is capable of being deformed to absorb deformation of the dielectric plate. Further, the thermal conductive layer comprises an indium foil.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
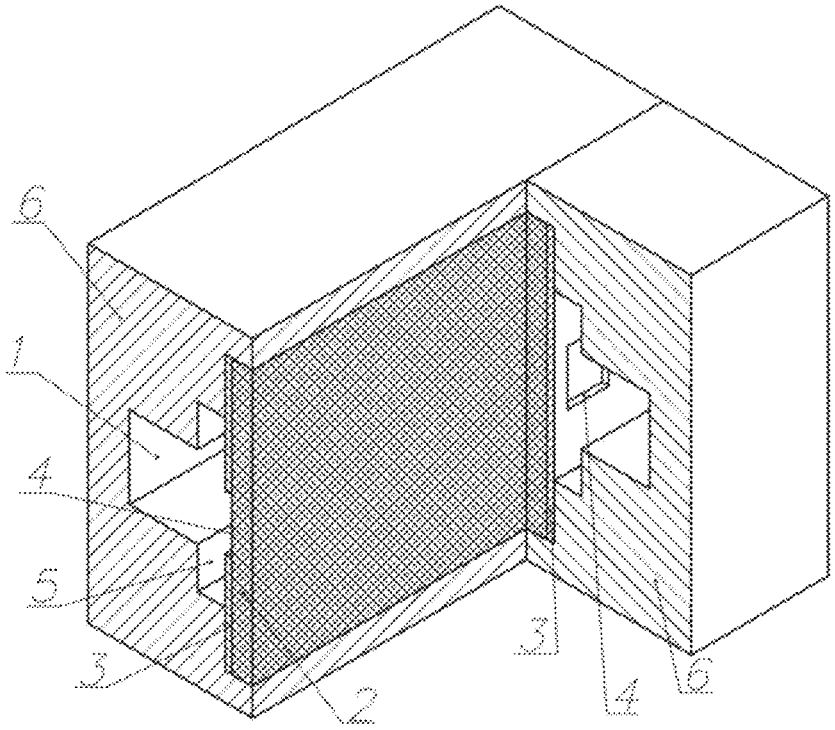
FIG. 1 is a perspective view of a band-pass filter according to an exemplary embodiment of the present invention.

Exemplary embodiments of the present invention are described hereinafter in details with reference to the attached drawings, wherein the like reference numerals refer to the like elements throughout the drawings. The present invention may, however, be embodied in many different forms and should not be construed as being limited to the embodiment set forth herein; rather, these embodiments are provided so that the present invention will be thorough and complete, and will fully convey the concept of the disclosure to those skilled in the art.

Figure 2:
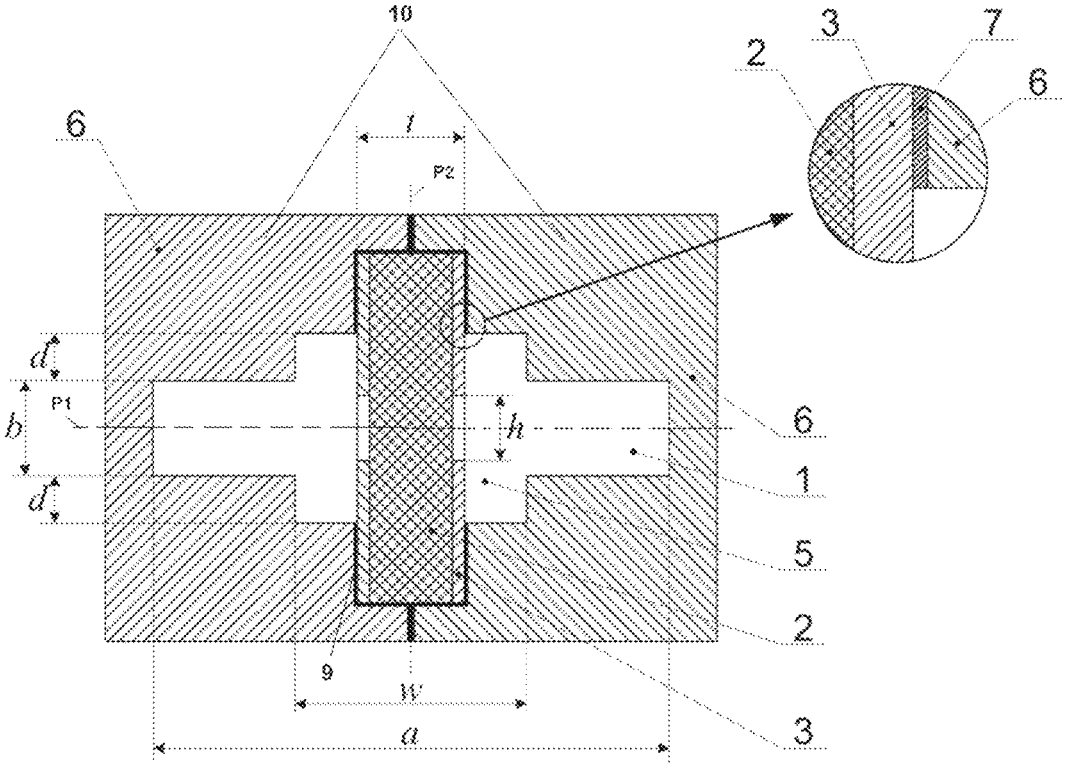
FIG. 2 is a cross-section of a waveguide in the band-pass filter in FIG. 1.
Figure 3:
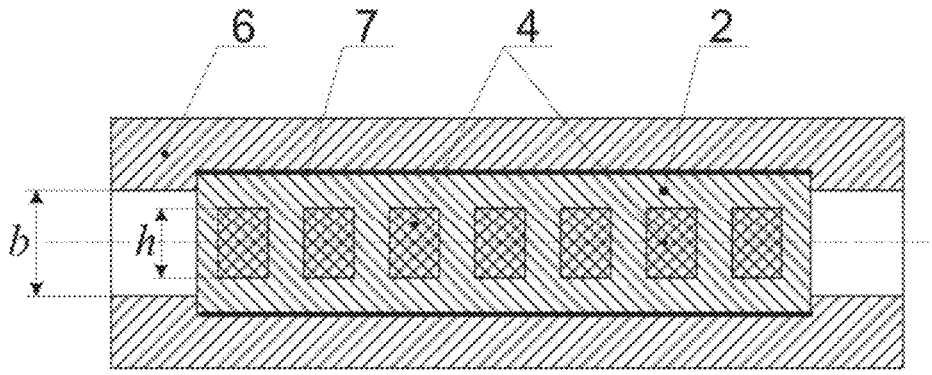
FIG. 3 is a cross-section of the band-pass filter in FIG. 1 along the bisecting plane P2 of FIG. 2.

As shown in FIGS. 1 and 2, a band-pass filter comprises a rectangular waveguide 1 of a×b cross-section (FIG. 2) and a dielectric plate (or substrate) 2. Identical HTS films 3 with a plurality of windows 4 (FIGS. 1 and 3) of the same height are placed symmetrically relative to a horizontal bisecting plane P1 (FIG. 2) of the rectangular waveguide. The windows 4 (FIG. 1) have different lengths and are spaced from each other by different distances. Specific dimensions of the windows 4 (FIG. 1) are determined by the characteristics of band-pass filters, which should be designed. The dielectric plate 2 is mounted in a perpendicular bisecting plane P2 (FIG. 2) of the long side walls of the rectangular waveguide 1. The dielectric plate 2 with the HTS films 3 and the rectangular windows 4 is referred to as the HTS insert or the dielectric insert.

As shown in FIGS. 1 and 2, rectangular recesses 5 of length equal to the length of the HTS insert are cut in both long side walls of the rectangular waveguide 1 along its axis direction of the rectangular waveguide 1. The rectangular recesses 5 are symmetrical with respect to the perpendicular bisecting plane P2. The HTS insert is fixed at the bottoms of the rectangular recesses 5 by means of fixing grooves 9 (FIG. 2).

The HTS film 3 may be provided only at one side of the dielectric plate 2.

Thus, the present invention provides a band-pass filter, comprising a body 10 (FIG. 2); a rectangular waveguide 1 defined in the body 10 (FIG. 2) and of a×b cross-section, wherein a is the length of a long side wall of the waveguide 1, b is the length of a short side wall of the waveguide 1, and each long side wall is provided at a central portion thereof with a fixing groove 9; and a dielectric insert, two ends of which are placed in the fixing grooves 9 respectively and which is arranged to be symmetric with respect to a perpendicular bisecting plane P2 of the long side wall, wherein the dielectric insert comprises a dielectric plate 2 and a HTS film 3 which is provided in line with a number of rectangular windows 4 of the same height.

Each long side wall is provided with a rectangular recess 5 in which the fixing groove 9 is formed, the rectangular recess 5 is symmetric with respect to the perpendicular bisecting plane P2, the length of the rectangular recess is the same as that of the waveguide 1, the width w (FIG. 2) of the rectangular recess 5 is less than a and is greater than a total thickness t (FIG. 2) of the dielectric plate 2 and the HTS film 3.

One way of fixing the dielectric plate 2 is to clamp the HTS insert between two identical half-bodies 6 forming the body 10. Surface profiles of the half-bodies 6 are made so that, after pressing the half-bodies together, both the rectangular waveguide 1 and the rectangular recesses 5 are formed. The rectangular waveguide 1 with the recesses in long side walls is often referred to cross waveguide in the literature. See Tham Q. C., Modes and Cutoff Frequencies of Crossed Rectangular Waveguides, IEEE Trans. Microwave Theory Tech., Vol. 25, No. 7, 1977, pp. 585-588. In order to form reliable thermal contact between the HTS insert and the half-bodies, it is desirable to interlay a thin thermo-conducting layer 7 (FIGS. 2 and 3), for example, of indium foil, between mating surfaces of the HTS insert and the half-bodies. In the invention, loss of microwave energy in the layer 7 is very small, even if the layer 7 has a low conductivity. At the same time, the layer 7 eliminates mechanical stresses in a dielectric plate 2 during cooling-heating cycles of the band-pass filter and thereby prevent the dielectric plate 2 from being damaged. The thermo-conducting layer 7 may have good ductibility or elasticity at cryogenic temperature such that the layer 7 is capable of being deformed to absorb the deformation of the dielectric plate 2. The thermo-conducting layer 7 may be made of indium foil.

Geometric dimensions of the rectangular recesses 5 depend on the thickness t and electro-physical characteristics of the HTS insert. The depth d (FIG. 2) of the rectangular recess should be large enough yet not exceed one-quarter of a wavelength (central wavelength of filter bandwidth) corresponding to a central frequency of the pass-band of the filter. Further, the recess width w is in the range of $t<w<a/2$. The height h (FIG. 2) of the windows 4 is determined primarily by the conductivity of the HTS material, and may lie in the range of $b/2<h<b$.

The principle of operation of the pass-band filter with the E-plane HTS insert in the cross-waveguide is similar to the principle of operation of the filter with the E-plane HTS insert in rectangular waveguide, and the differences therebetween lie in methods of electro-magnetic analysis of the filters, as well as the ability to improve the filter performance.

The most effective method of electro-magnetic analysis of band-pass filters with required technical characteristics (such as, bandwidth, the level of return losses, and band-edge slopes) is to pay more attention to key characteristics, and then to get, based on the key characteristics, scattering matrices satisfying the key characteristics. During the initial stage of the design, based on the scattering matrices, a so-called filter-prototype is calculated and obtained by establishing an equivalent circuit mode. Then, a parameter function which depends on the geometry structure of the band-pass filter is established based on the required technical characteristics, and finally the required technical characteristics are met by optimizing the geometry structure of the band-pass filter.

Now the filters with the E-plane metal inserts or fin-line inserts in rectangular waveguide are designed accordingly, see, e.g., R., Bornemann, J., Arndt, F., and Grauerholz D., Optimized Waveguide E-Plane Metal Insert Filters for Millimeter—Wave Applications, IEEE Trans. Microwave Theory Tech., Vol. 31, No. 1, pp. 65-69, 1983. and Arndt, F., Bornemann, J., Grauneryolz, D., Vahldieck, R., Theory and Design of Low-Insertion Loss Fin-Line Filters, IEEE Trans. Microwave Theory Tech., Vol. 30, No. 2, 1982, pp. 155-163. In order to analyze the filters with E-plane inserts of the fin-line type in a cross waveguide, it is necessary to know a complete set of Eigen functions of the electromagnetic field in the cross waveguide. Currently, the electromagnetic characteristics of the band-pass filter of the present invention may be analyzed by means of fitting method of solving Maxwell equations using CST software, e.g., CST Microwave Studio.

During the first stage, an initial solution of a band-pass filter-prototype is calculated by means of the theory of circuits, and parameters of the pass-band filter, i.e., the number of poles of the filter, Eigen frequencies of the resonators of the filter, coefficients of mutual coupling of the resonators of the filter and external Q-factors $Q_{EX}$ of the end resonators, are determined, see J. L. Matthaei, L. Young, E. M. T. Jones, Microwave Filters, Impedance-Matching Networks, and Coupling Structures, McGraw-Hill Co., 1968.

Figure 4:
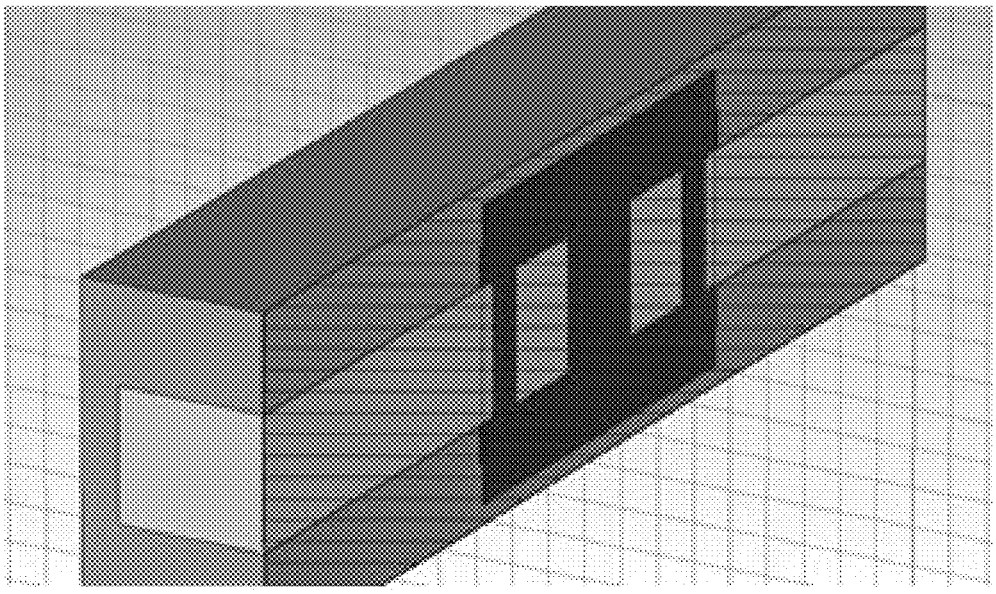
FIG. 4 is a schematic view showing a CST model of two coupled resonators in the band-pass filter in FIG. 1 according to an exemplary embodiment of the present invention.
Figure 5:
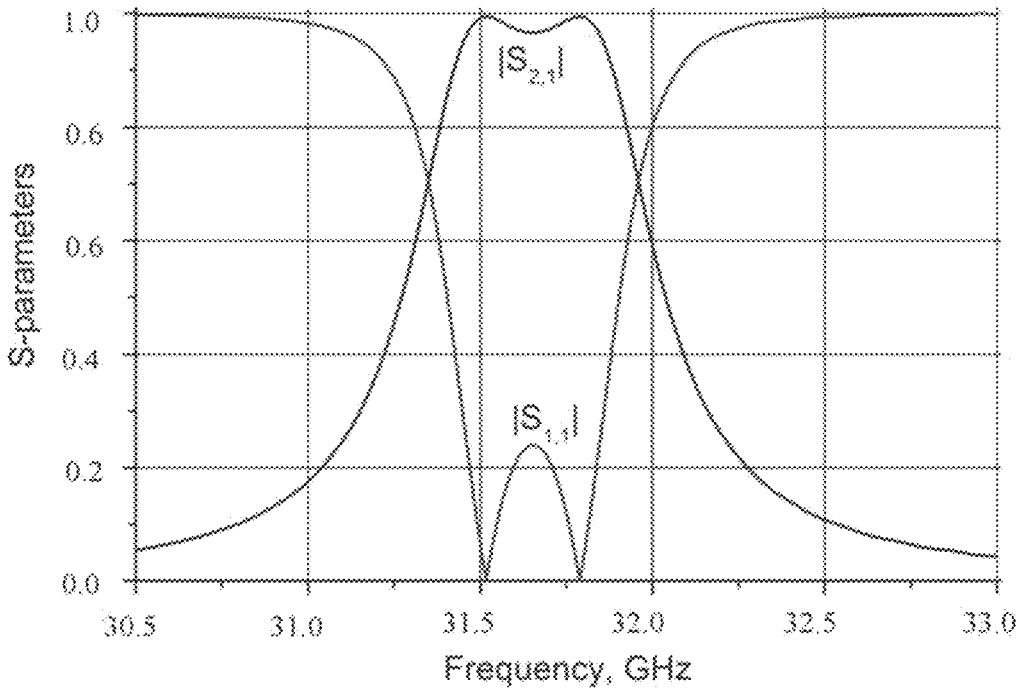
FIG. 5 shows an example of S-parameters, $|S_{1,1}|$ and $|S_{2,1}|$ in relative magnitudes vs. frequency in GHz, of the two coupled resonators of FIG. 4 in the band-pass filter.

During the second stage, the initial values for the following parameters are given: (i) the resonator lengths (i.e., the window lengths), which determine the Eigen frequencies of the resonators, (ii) the lengths of the sections of the mutual coupling (i.e., distance between the windows), which determine the coefficients of the mutual coupling of the resonators, and (iii) the lengths of the end sections of the rectangular waveguide coupling with input and output lines, which determine the external Q-factors $Q_{EX}$ of the end resonators (it is noted that values of the external Q-factors $Q_{EX}$ are influenced also by the dimensions of the cross-section of the rectangular recess). For this purpose, a CST model of the coupled resonators is created by using CST software "CST Microwave Studio" as shown in FIG. 4. A curve showing frequency dependences between frequency and S-parameters is calculated and presented in FIG. 5. S-parameters are scattering matrix elements, and they are used for description of passive microwave devices performance including filters. The absolute values of S-parameters are measured as relative magnitudes or in dB. $|S_{1,1}|$ is the reflection coefficient of the filter input and $|S_{2,1}|=|S_{1,1}|$ is the transfer coefficient, which is the insertion loss factor in the filter. FIG. 4 shows two light rectangular windows in the E-plane black insert situated in the longitudinal section of the waveguide. They, along with the short walls of the waveguide, are two resonators of the filter. The hatching shows the longitudinal section of the waveguide body. Based on the S-parameter curve, the Eigen frequencies of the resonators and the mutual coupling coefficients of the resonators are calculated by means of a method of extracting S-parameters raised by the inventors, see, V. N. Skresanov, V. V. Glamazdin, and N. T. Cherpak, "the Novel Approach to Coupled Mode Parameters Recovery from Microwave Resonator Amplitude—Frequency Response," European Microwave Conference, EuMW 2011 Conference Proceedings, 9-14 Oct. 2011, Manchester, UK, EuMA, 2011, pp. 826-829. The parameters of the equivalent circuits and the parameters of the initial solution of the band-pass filter may be adjusted by changing the lengths of windows and distance therebetween.

Figure 6:
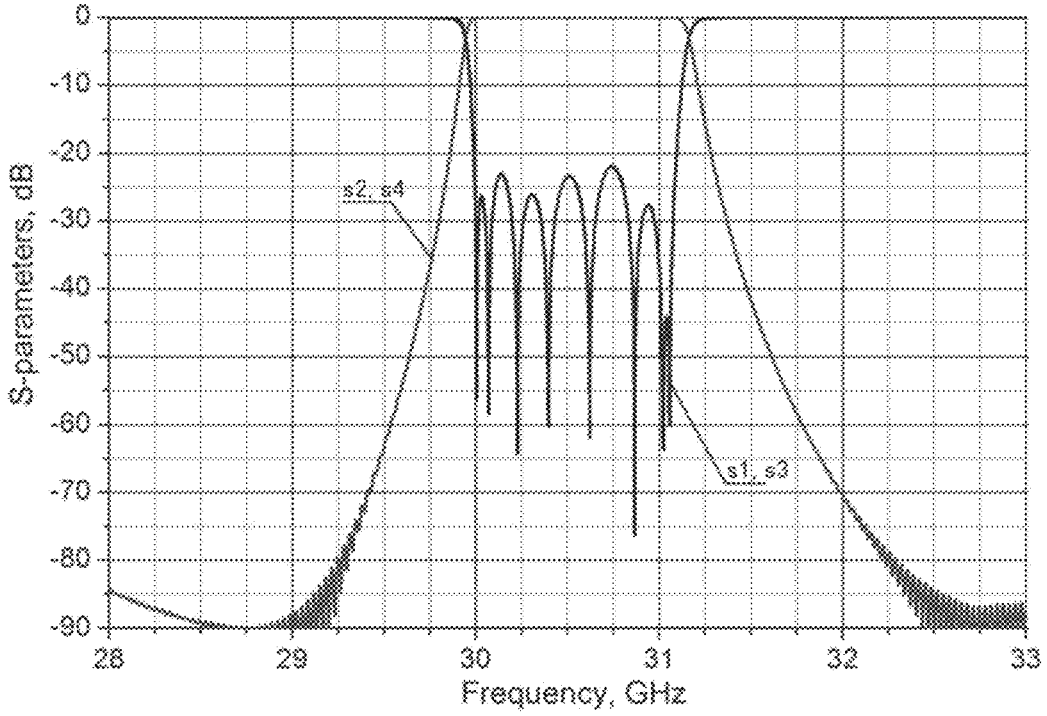
FIG. 6 shows the frequency dependences in GHz of S-parameters of an eight-pole band-pass filter.
Figure 7:
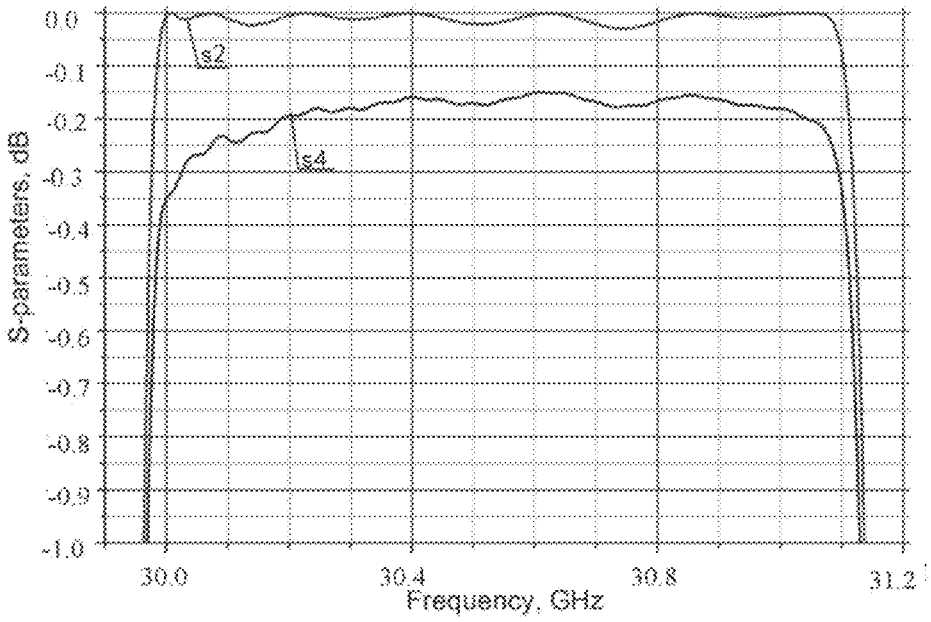
FIG. 7 shows the frequency dependence in GHz of S-parameter $|S_{2,1}|$, i.e. insertion loss of the eight-pole band-pass filter.

During the third stage, the CST model of the pass-band filter is created based on the model of the band-pass filter and the coupling model between the resonators created in the second stage. The lengths of resonators and distances therebetween may be further determined accurately by creating an objective function based on the specifications or characteristics of the band-pass filter to be designed and by using an optimization gradient method of the CST software. FIGS. 6 and 7 show simulation results of an eight-pole filter, wherein curve s1 (FIG. 6) for $|S_{1,1}|$ and curve s2 for $|S_{2,1}|$ correspond to parameters of elements of the filter without losses. In FIGS. 6 and 7, characteristics of the filter are given as follows: a central frequency is 30.5 GHz, a pass-band at the −3 dB level is 1.2 GHz, a pass-band at the −70 dB level is not more than 3 GHz, and a return loss is not worse than 25 dB.

Curves s3 and s4 in FIG. 6 and FIG. 7, respectively show the frequency characteristics $|S_{1,1}|$ and $|S_{2,1}|$ of the band-pass filter taking into account Joule loss in the elements of the band-pass filter at an operation temperature of 77K. During simulating, loss tangent of the MgO dielectric substrate tan $\delta=6.2\cdot10^{-6}$, conductivity of the metal walls of the waveguide $\sigma_{Ag}=5.56\cdot10^{8}$ S/m and the equivalent conductivity of the HTS material $\sigma_{HTS}=1.0\cdot10^{10}$ S/m are set. The simulating results show that the expected insertion loss of the eight-pole filter does not exceed 0.2 dB. Approximately the same calculated result can be obtained for a band-pass filter with an E-plane HTS insert in a rectangular waveguide, assuming no loss in the area of the contact of the HTS insert with the waveguide body. As seen from FIG. 7, the Joule loss increases the filter insertion loss. In practice, the losses in the area of the contact of the HTS insert with the waveguide body always exist. Therefore, real parameter of $|S_{2,1}|$ is expected worse (in FIG. 7, the curve s4 is lower), i.e., losses are higher.

Figure 8:
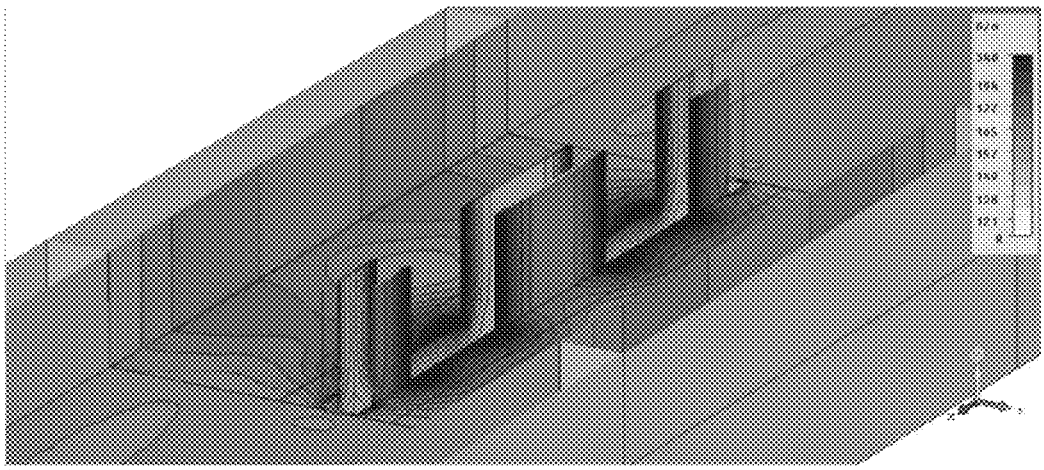
FIG. 8 shows the current distribution in the coupled resonators in band-pass filter with HTS insert in a rectangular waveguide.
Figure 9:
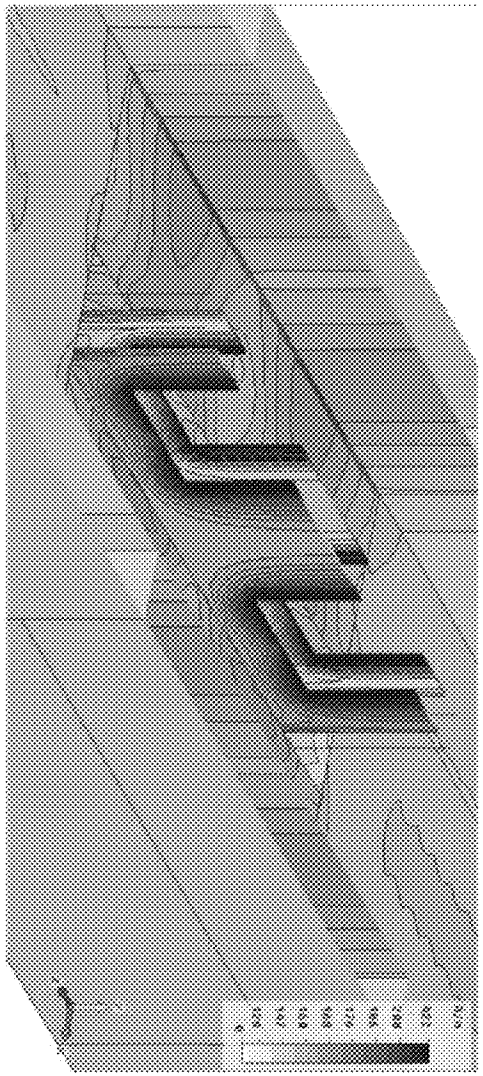
FIG. 9 shows the current distribution in the coupled resonators of band-pass filter with HTS insert in the cross waveguide according to an exemplary embodiment of the present invention.

The rectangular recesses in the long side walls of the rectangular waveguide can reduce the losses in the contact region between the HTS insert and the waveguide to a negligible value. FIG. 8 and FIG. 9 show the distribution of surface currents in the waveguide walls, and the distribution of surface currents in the HTS layers of E-plane HTS inserts in a rectangular waveguide and in a cross waveguide, respectively. It is clearly seen that the current density at the contact region in the rectangular waveguide is much higher than the current density at the contact region in the cross waveguide. Consequently, for the same contact resistance, losses in the cross waveguide will be smaller.

Figure 10:
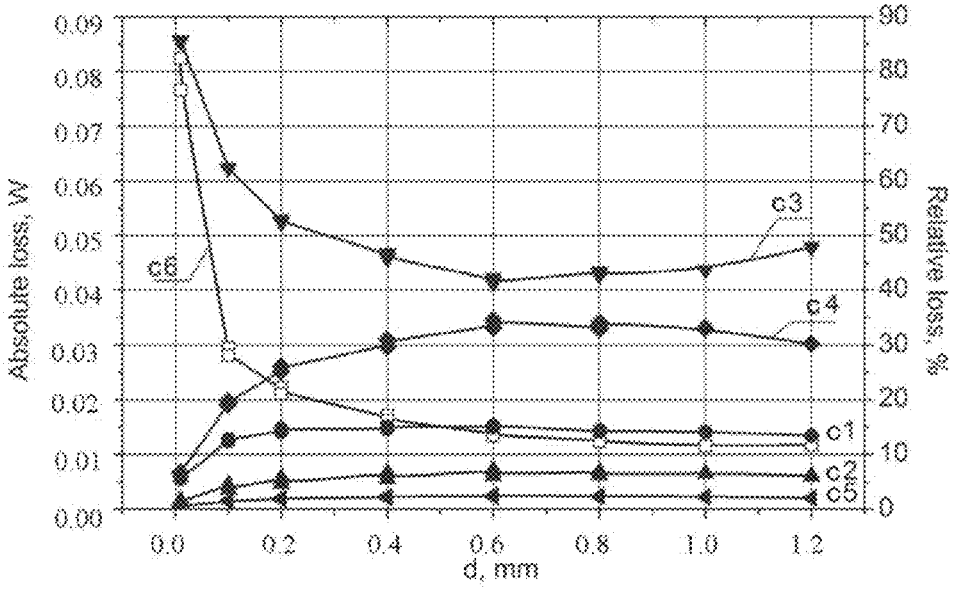
FIG. 10 shows dependence of loss in elements of band-pass filter on a depth of the rectangular recesses.

A quantitative analysis may be carried out on this effect using a procedural Loss and Q Calculation in CST Microwave Studio. FIG. 10 shows the dependence of the Joule losses in the various elements of the band-pass filter on the depth d in mm of the recesses. Obviously, in the special case for the depth d=0, a cross waveguide is transformed into a rectangular waveguide (see FIG. 2). Losses are calculated in the horizontal and vertical walls of the waveguide (curves c1 and c2), in the HTS layers (curve c4), in the dielectric plate (curve c5) and finally in the contact regions (curve c3), assuming that the metal layers are of 0.05 mm thickness and have a poor conductivity ($\sigma_c=1.0\ 10^5$ S/m). Relative losses in these elements of the band-pass filter are shown, taking 100% as the total loss for each case of the geometry, i.e., for each particular recess depth. In addition, the total loss for 1 W incident power is calculated for each filter geometry (curve c6). In FIG. 10, the total loss is presented as an absolute loss through W.

It can be seen from FIG. 10 that with the increase in the depth d of the recesses, the total loss initially decreases fast, and after a certain value (in this case $d\approx0.5$ mm), the total loss remains approximately the same. It happens due to the lower loss in the contact regions. For $d>0.5$ mm, the loss in the contact region is comparable with the losses of other components.

Optimal sizes of the rectangular recesses 5 for a given center frequency in the filter pass-band depend on the thickness of the dielectric plate 2 and the electro-physical characteristics of the HTS layers 3. As mentioned above, the optimum sizes of the recesses 5 are as follows: the recess depth d satisfies $d<\lambda/4$, where $\lambda$ is the wavelength (central wavelength of filter bandwidth) corresponding to a central frequency of the pass-band of the filter, and the recess width w satisfies $t<w<a/2$, where t is the total thickness of the dielectric plate 2 and HTS films 3.

In addition to reducing the losses in the contact regions by using a cross-waveguide, another method may be used to reduce losses, that is, using HTS layers of a lower surface resistance $R_s$ or using HTS layers of a high equivalent conductivity $\sigma_{HTS}$. For example, in the circumstance of a centimeter wave and a wave having a higher frequency, equivalent conductivity $\sigma_{HTS}$ is above $1.0\times10^{12}$S/m. The placement of the HTS insert causes the electro-magnetic fields within the waveguide to be concentrated more in the HTS layers and thus reduces intensity of the field in the rest of the waveguide, in this case, the HTS insert corresponds to an open transmission line.

This transmission line is similar to a shielded slot line. With the decrease in the window height h, the electro-magnetic field is more concentrated in the resonators of the HTS insert. Obviously, the higher the equivalent conductivity of HTS layers and the lower dielectric loss in the dielectric plate, the less the total electro-magnetic losses caused by the HTS insert. The effect may be reflected in the results by further imposing conditions on the height h of the windows.

The parameters that may affect the specifications or characteristics of the band-pass filter are analyzed below. The insertion losses in the pass-band filter are determined by the relationship between Eigen (or intrinsic) Q-factor $Q_0$ and the external Q-factor $Q_{EX}$ of the resonator of the filter. For a pair of coupled resonators, the following formula (1) for the insertion losses L in terms of dB is satisfied, see J. L. Matthaei, L. Young, E. M. T. Jones, Microwave Filters, Impedance—Matching Networks, and Coupling Structures, McGraw Hill Co., 1968, p. 665:

$$L = 20lg\left(\frac{1 + Q_{EX}/Q_0}{2kQ_{EX}} + \frac{kQ_{EX}}{2}\right) \quad (1)$$

where k is the coupling coefficient between the resonators.

Eigen Q-factor $Q_0$ is inversely proportional to the insert loss, therefore, the insertion loss of the filter decreases with the HTS material with a high equivalent conductivity, especially in the low-frequency part of the microwave range.

Figure 11:
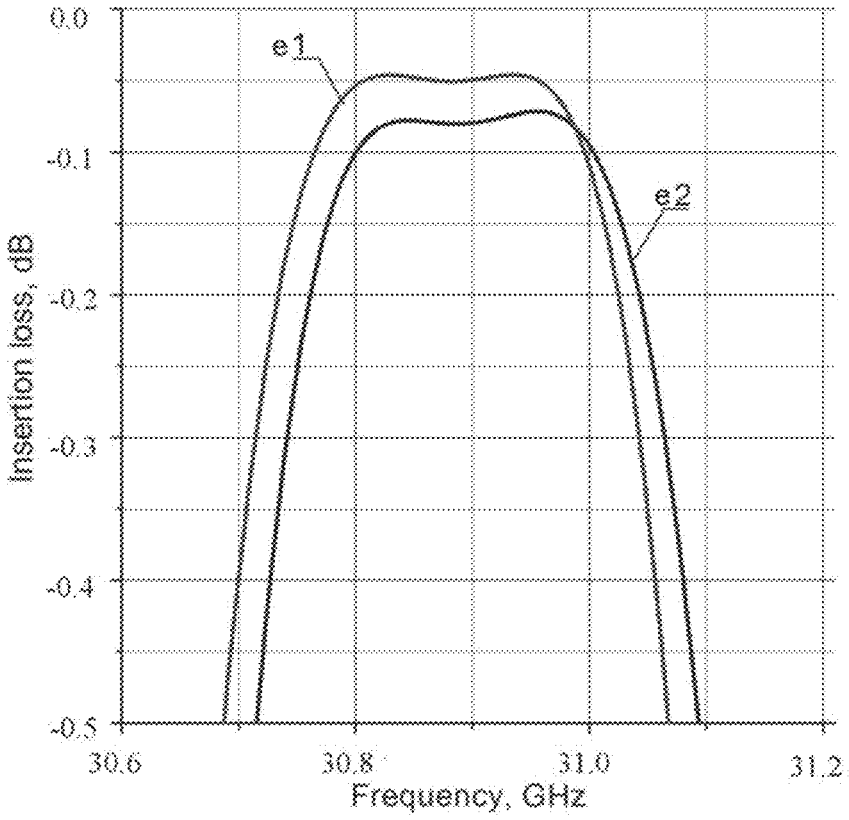
FIG. 11 shows the insertion losses in dB vs. frequency in GHz of two two-pole band-pass filters with the same bandwidth equal to 250 MHz, wherein curve e1 corresponds to a band-pass filter with an E-plane copper insert in a rectangular waveguide at an operating temperature of 77K and curve e2 corresponds to a band-pass filter with E-plane HTS insert in the cross waveguide at an operating temperature of 77K.

External Q-factor $Q_{EX}$ determines the bandwidth. When the bandwidth is reduced, it is necessary to increase the external Q-factor $Q_{EX}$. It increases the ratio $Q_{EX}/Q_0$ and according to formula (1), the increase in the ratio will increase the insertion loss. Therefore, the advantages achieved by using the HTS insert will be more prominent for narrow-band filters. FIG. 11 shows the calculated insertion losses of two two-pole band-pass filters of Ka band and with a bandwidth of 250 MHz at the operation temperature of 77K. One of the two-pole band-pass filters has an E-plane copper insert in the waveguide thereof, and the other of the two-pole band-pass filters has an E-plane HTS insert in the waveguide thereof. It can be seen that for the two-pole band-pass filter, the band-pass filter with the HTS insert gains $\Delta L_2$=0.06 dB compared with the band-pass filter with the copper insert.

With the growing number of the filter poles, insert losses increase. Therefore, the gain by introducing the HTS insert increases with the growing number of the filter poles. To gain evaluate the gain $\Delta L_n$ for the multi-pole filter, the following formula (2) is used for insertion losses $L_n$, see J. L. Matthaei, L. Young, and E. M. T. Jones, Microwave Filters, Impedance—Matching Networks, and Coupling Structures, McGraw Hill Co., 1968:

$$L_n[\text{dB}] \approx 8.69 C_n \delta, \quad (2)$$

where n is the number of the filter poles; δ is the attenuation rate of oscillations in the resonators of the filter; $C_n$ is the coefficient dependent on the number of poles of filter.

For the filter with Butterworth characteristics, the following conditions are met: $C_1$=1.0; $C_2$=1.4; $C_3$=2.0; $C_4$=2.6; $C_5$=3.2; $C_6$=3.9; $C_7$=4.5; $C_8$=5.1.

It can obtain the following formula (3) based on formula (2):

$$L_8[\text{dB}] = L_2(C_8/C_2) = 3.64L_2. \quad (3)$$

Formula (3) may be used for calculating the loss increase or decrease. By substituting the numerical experiment value $\Delta L_2$=0.06 dB (FIG. 11) into formula (4):

$$\Delta L_8[\text{dB}] = \Delta L_2(C_8/C_2) = 3.64\Delta L_2. \quad (4)$$

it obtains $\Delta L_8$=0.2 dB, which is a quite significant value. For even more narrow band-pass filters, the value is even greater.

Thus, the use of band-pass filters with E-plane HTS inserts is advisable in cryo-electronic units of the microwave high-sensitive receivers that require narrow-band filters with steep fronts. The band-pass filter of the present invention, in comparison with the current filters, enables the gain in the insertion loss due to a reduction of loss in the contact area between the HTS insert and a waveguide body, and increases the reliability of the design by eliminating the causes of the destruction of the dielectric substrate with the HTS material.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

We claim:

1. A band-pass filter, comprising:

a body;

a rectangular waveguide defined in the body, the waveguide having long side walls and short side walls defining an a×b cross-section, wherein a is a length of the long side walls of the waveguide, b is a length of the short side walls of the waveguide, and each long side wall is provided at a central portion thereof with a fixing groove; and a dielectric insert having two ends, the two ends of the dielectric insert being placed in the fixing grooves respectively, and the dielectric insert being symmetric with a perpendicular bisecting plane of the long side walls, and further comprising a dielectric plate and a high temperature superconductive film, the high temperature superconductive film comprising a plurality of rectangular windows of a same height, wherein each long side wall is provided with a rectangular recess, and the corresponding fixing groove is formed in each of the rectangular recesses of the long side walls; each of the rectangular recesses is symmetric with the perpendicular bisecting plane of the long side walls and each rectangular recess has a same length as the length of the waveguide; and a width w of each of the rectangular recesses is less than the length a of each long side wall and greater than a total thickness t of the dielectric plate and the high temperature superconductive film, and a depth d of each of the rectangular recesses satisfies d<λ/4, λ is a wavelength corresponding to a central frequency of a pass-band of the band-pass filter.

2. The band-pass filter of claim 1, wherein the width w of each of the rectangular recesses satisfies t<w<a/2.

3. The band-pass filter of claim 2, further comprising a respective thermal conductive layer between an inner wall of each fixing groove and an outer surface of a corresponding end of the dielectric insert placed thereinto, wherein the respective thermal conductive layer is capable of being deformed to absorb deformation of the dielectric plate.

4. The band-pass filter of claim 3, wherein the respective thermal conductive layer comprises an indium foil.

5. The band-pass filter of claim 1, wherein both sides of the dielectric plate are provided with the high temperature superconductive film.

6. The band-pass filter of claim 1, wherein the body is formed by two halves, and the two halves are symmetric with the perpendicular bisecting plane, and the two ends of the dielectric insert are held by the two halves.

7. The band-pass filter of claim 1, wherein a height h of each of the rectangular windows satisfies $b/2<h<b$.

8. The band-pass filter of claim 1, further comprising a respective thermal conductive layer between an inner wall of each fixing groove and an outer surface of a corresponding end of the dielectric insert placed thereinto, wherein the respective thermal conductive layer is capable of being deformed to absorb deformation of the dielectric plate.

9. The band-pass filter of claim 8, wherein the respective thermal conductive layer comprises an indium foil.

* * * * *